US007979014B2

(12) United States Patent
Achten et al.

(10) Patent No.: US 7,979,014 B2
(45) Date of Patent: Jul. 12, 2011

(54) APPARATUS AND METHOD FOR RELEASE AGENT APPLICATION AND CLEANING OF A FUSER SURFACE USING A RELEASE AGENT IMPREGNATED WEB

(75) Inventors: Maarten Achten, Zonhoven (BE); Kurt Mampaey, Rumst (BE); Dirk Broddin, Terneuzen (NL); Eric Van Weverberg, Mortsel (BE)

(73) Assignee: Xeikon Manufacturing NV, Lier (BE)

( * ) Notice: Subject to any disclaimer, the term of this patent is extended or adjusted under 35 U.S.C. 154(b) by 413 days.

(21) Appl. No.: 12/262,389

(22) Filed: Oct. 31, 2008

(65) Prior Publication Data

US 2009/0123200 A1 May 14, 2009

(30) Foreign Application Priority Data

Nov. 1, 2007 (EP) ..... 07075950

(51) Int. Cl.
*G03G 15/20* (2006.01)

(52) U.S. Cl. ..... 399/327; 399/325

(58) Field of Classification Search ..... 399/325–327
See application file for complete search history.

(56) References Cited

U.S. PATENT DOCUMENTS

| | | | | |
|---|---|---|---|---|
| 5,045,890 | A | 9/1991 | DeBolt et al. | |
| 5,420,679 | A | 5/1995 | Goto et al. | |
| 5,978,640 | A | 11/1999 | Segawa | |
| 5,987,293 | A | 11/1999 | Diels | |
| 6,002,894 | A | 12/1999 | De Niel et al. | |
| 6,365,279 | B1 | 4/2002 | De Meutter et al. | |
| 6,377,774 | B1 * | 4/2002 | Maul et al. | 399/325 |
| 6,411,785 | B1 | 6/2002 | Ogawahara et al. | |
| 6,449,455 | B1 | 9/2002 | Lebold et al. | |
| 6,876,832 | B2 | 4/2005 | Pirwitz et al. | |
| 6,890,657 | B2 | 5/2005 | Pickering et al. | |
| 2004/0247351 | A1 | 12/2004 | Pirwitz et al. | |
| 2005/0019069 | A1 * | 1/2005 | Katayanagi et al. | 399/327 |
| 2007/0116499 | A1 * | 5/2007 | Derimiggio et al. | 399/327 |

FOREIGN PATENT DOCUMENTS

| | | |
|---|---|---|
| EP | 1 072 962 A2 | 1/2001 |
| JP | 11-52632 | 2/1999 |
| WO | WO 02/29499 A1 | 4/2002 |

OTHER PUBLICATIONS

Search Report of European Patent Office related to European Patent Application No. 07075950.1, Apr. 17, 2008.
Official Action of EPO regarding EP 07 075 950.1, Apr. 23, 2010.

* cited by examiner

*Primary Examiner* — David M Gray
*Assistant Examiner* — Joseph S Wong
(74) *Attorney, Agent, or Firm* — Bacon & Thomas PLLC

(57) ABSTRACT

An apparatus and method to condition the fuser surface of a fusing or transfusing apparatus for a toner based printing system is described. The apparatus and method integrate the functions of cleaning paper debris and residual toner from the fuser (or transfuse) surface on one hand and the application of a release agent such as silicone oil on the other hand using a single release agent impregnated web. The inventive device includes a release agent application roller and a cleaning roller where the outer surfaces and are selected in preferred embodiments for their respective wetting properties with respect to the release agent used. The fuser surface conditioning device increases the useful life for a fusing or transfusing roll or belt even when low amounts of release agent are applied to the fusing surface such that the amount of release agent that is transferred to the print media is in the range of 0.5 to 5 mg/A4 sheet.

20 Claims, 9 Drawing Sheets

APPARATUS AND METHOD FOR RELEASE AGENT APPLICATION AND CLEANING OF A FUSER SURFACE USING A RELEASE AGENT IMPREGNATED WEB

The present invention relates to a fusing or transfusing apparatus for a toner based printing, fax or copying system and a method for conditioning a fuser (or transfuse) surface of said fusing apparatus or transfusing apparatus as well as to a printer, fax or copier using the fusing or transfusing apparatus and to a method of printing using the conditioning method. The apparatus and method can integrate the functions of cleaning paper debris and residual toner from the fuser (or transfuse) surface on one hand and the application of a release agent such as silicone oil on the other hand using a single release agent impregnated web.

TECHNICAL BACKGROUND

With a conventional electrophotographic printer, a charging device charges the surface of a photoconductive drum or belt and an exposing unit such as an LED head writes an electrostatic latent image on the charged surface of the photoconductive drum. The electrostatic latent image is developed with toner into a toner image, which is subsequently transferred to a print medium. The toner image on the print medium is then permanently fixed onto the print medium by a fixing unit.

In the electrophotographic art multi-colour printers are known that produce a plurality of colour toner images on a photoconductive drum or endless belt wherefrom the toner images are transferred directly onto printing stock material such as a paper sheet or paper web material. In an alternative embodiment the toner images formed on a photoconductive recording member are transferred subsequently to an intermediate insulating belt from distinct image forming stations and are then transferred simultaneously to a receiving sheet or web. The multicolour toner image on the print medium is then permanently fixed by a fixing unit into a colour copy or colour print.

Different methods and apparatuses are used for fusing toner images. Non-contact fusing relies on convection of a heated gas such as air or exposure to electromagnetic radiation to soften the toner resins to such an extent that the molten toner particles start to flow and adhere to each other and to the print medium. Non-contact fusing systems are popular for printing on an endless web of print medium (30).

Contact fusing methods as in FIG. 1 use a combination of heat and pressure to melt the toner image onto the print medium as the print medium (30) with the unfused toner image (31) passes trough a pressure contact area between a pair of rollers (10) and (13) wherein at least one roller has a heating source (12). Contact fusing can be used with print media in the form of sheets as well as in the form of an endless web as represented in FIG. 3.

The internal heating system (12) can be assisted by one or more external heating rollers as described in U.S. Pat. No. 6,411,785 and U.S. Pat. No. 6,890,657.

In an alternative transfuse architecture toner images formed on a photoconductive recording member are transferred subsequently to an intermediate insulating belt from distinct image forming stations and are then transferred simultaneously to a heated belt or drum. In the final transfer the molten toner image is transferred from the transfuse belt or drum to the final medium in a contact area by means of a tacky pressure transfer.

The more common configuration is where a multicolour unfused toner image, transferred to the print medium in a previous step is permanently fixed by a fixing unit into a colour copy or colour print as a separate step.

At least one of the rollers (10), (13) contacts a side of the print medium (30) carrying unfused toner images (31). In FIG. 1A the upper roller (10) is the heated fuser roller equipped with an internal heater (12). In the case of a system as in FIG. 1A, which we will further refer to as a simplex fusing system, only roller (10) contacts an unfused image that needs to be fused and is referred to as a fusing roller and the opposing roller (13) is referred to as a pressure roller. For this roller heating is optional. The fuser roller (10) and/or the pressure roller (13) can be replaced by a belt that is guided over 2 or more guiding rollers.

Fuser systems as in FIG. 1A typically fix the toner images on duplex copies in two passes. The print medium (30) with already fused first image (32) as obtained after the fusing of FIG. 1A can be fed a second time into the print system for generating an additional unfused image (131) on the reverse side of the print medium (30) for subsequent fusing as shown in FIG. 1B.

Simultaneous duplex printing systems as in FIG. 1C provide unfused toner images (31),(131) on both sides of a print medium (30) for single pass fusing in the pressure contact area between a pair of fusing rollers (10) and (110) which typically both comprise heaters (12) and (112) and optional additional external heaters. U.S. Pat. No. 6,002,894 describes amongst others such simultaneous duplex fuser embodiments.

Fuser rollers and belts, pressure rollers and belts and transfuse rollers or belts typically comprise one or more elastomer or polymer layers bonded on a mechanically stable belt or cylinder by optional bonding agents. Intermediate layers are typically chosen in function of thermal conductivity and conformance. The outer surface of the fusing surface (14) is typically a high release material and selected from material groups such as silicone resins, fluoropolymers, fluoroelastomers and hybrid compositions thereof comprising a number of proprietary additives and fillers to achieve targeted properties. U.S. Pat. No. 6,365,279 describes an example of a silicone based composition used as an outer layer of a fusing roll or belt.

In most applications of both a fusing roller or belt or transfuse roller or belt, a release agent or parting agent, most frequently a silicone oil, is applied to the fusing roller or belt or transfusing roller or belt to prevent offset (i.e. toner particles adhering to the surface of the fuser roller or belt or transfusing roller or belt instead of to the print medium surface) and to enhance the lifetime or the surface (14) of the fusing roller or belt or transfusing roller or belt Release agent application systems (29) typically comprise a number of release agent transfer rollers represented in FIG. 2 A. U.S. Pat. No. 5,987,293 describes a typical multiroller oiling system for controlled transfer of a thin layer of release agent to the fuser surface (14).

For the removal of debris and toner contaminants from the fuser roller, fuser surface cleaning systems have been proposed. FIG. 2 shows a prior art type web based cleaning system comprising a supply spool (20) of cleaning web (27) a sponge type pressing roller (25) for pressing the web (21) towards the fusing surface (14) and a take-up spool (22). These webs are typically non-woven polyester/Aramid fibre webs that do not contain any significant amounts of release agent prior to being used. Use of such webs in the function of cleaning the surface by direct contact with the fuser surface (14) has been described in U.S. Pat. No. 5,420,679, U.S. Pat.

No. 6,876,832, and U.S. Pat. No. 6,411,785. Use of a similar web immersed in release agent (21) as a release agent supply means in direct contact with the fusing surface (14) as shown in FIG. 2 B has been proposed in U.S. Pat. No. 5,045,890. The web (21) is advanced at a speed of centimeters per minute whereas the surface rotation speed of the fuser surface (14) is typically in the range from 10 to 50 cm/s.

Systems as in FIG. 2 B have the drawback that the nearly stationary web (21) scratches and wears out the fusing surface (14). The nearly stationary web may accumulate contaminants such as paper debris that remain trapped and stationary in the contact area with the fusing surface of the rotating fuser roller or fusing or transfusing belt, and cause local abrasion that degrades the fusing surface. To reduces this type of wear, the use of advanced materials such as PTFE for the fibres of the web have been proposed for the web (21) to reduce the rate of damage to the fusing surface (14). Moreover debris and toner contaminants may still degrade the fuser surface (14) and such contaminants trapped between the web (21) and the fusing surface (14) interfere with the uniform release agent delivery giving rise to visible streaks of release agent on the final print that affect the uniformity of the gloss of the print as discussed in U.S. Pat. No. 6,449,455.

There remains a need for a fuser surface conditioning system that

- implements the function of cleaning paper debris and toner contaminants
- implements a release agent application function capable of uniform application of small amounts of release agent
- is more compact than prior art systems with separated functions of release agent application and fuser surface cleaning
- is convenient in terms of reducing the amount of user replaceable fluids and or webs.
- avoids maintenance and service issues associated with circulating release agent fluids
- further reduce the wear of the fuser surface by avoiding direct contact of the fuser surface with stationary or nearly stationary cleaning means.

SUMMARY OF THE INVENTION

The present invention provides an apparatus for fusing or transfusing a toner based image on a print medium comprising

- a release agent impregnated web
- a cleaning means such as a cleaning roller that rotates in a rolling contact with the fuser surface at a first surface speed
- a release agent application roller that rotates in a rolling contact with the fuser surface at said first surface speed wherein said release agent impregnated web is advanced at a second surface speed along a trajectory from a supply spool over a first contact area with said release agent application roller to a take-up spool, wherein said second surface speed is at least 100 times lower than said first surface speed.

The above arrangement has the advantage that less release agent can be transferred to the printed images or at least the amount of release agent can be better controlled. The use of a release agent improves the lifetime. The slow advancement speed of the web increases the times between replacement, i.e. reduces downtime.

A further cleaning means can be provided to remove toner contaminants and/or paper debris from the cleaning roller. Such means can be a separate web or a scraper system or even it can be the same web as the release agent web. This provides a more optimal use of space, reduction of the number of replaceable components and reduction in the amount of hardware needed The present invention also provides an apparatus for fusing or transfusing a toner based image on a print medium comprising:

- a release agent impregnated web
- a cleaning roller that rotates in a rolling contact with the fuser surface at a first surface speed
- a release agent application roller that rotates in a rolling contact with the fuser surface at said first surface speed wherein said release agent impregnated web is advanced at a second surface speed along a trajectory from a supply spool over a first contact area with said release agent application roller, a second contact area with said cleaning roller to a take-up spool, wherein said second surface speed is at least 100 times lower than said first surface speed.

This arrangement provides all the advantages of the previous arrangement and also provides a more optimal use of space, reduction of the number of replaceable components and reduction in the amount of hardware needed The cleaning roller has a first surface and said release agent application roller has a second surface and preferably the contact angle at room temperature of a silicone fluid droplet on said first surface is more than 2 times bigger than the contact angle on said second surface.

The surface energy of the first surface is preferably less than 30 dyne/cm. The release agent impregnated web is preferably loaded with release agent at a rate of 10-60 gr/m$^2$. The release agent is preferably a silicone or silicone derived release agent. The viscosity of the release agent is preferably between 1000 and 20000 centistokes at room temperature.

The contact region of the release agent impregnated web and the cleaning roller is preferably a pressure contact provided by a conformable sponge rubber type pressing roller engaged against said cleaning roller.

The present invention also provides a method for fusing or transfusing a toner based image on a print medium using a fusing or transfusing apparatus comprising

- a release agent impregnated web
- a cleaning means such as a cleaning roller that rotates in a rolling contact with the fuser surface at a first surface speed
- a release agent application roller that rotates in a rolling contact with the fuser surface at said first surface speed wherein said release agent impregnated web is advanced at a second surface speed along a trajectory from a supply spool over a first contact area with said release agent application roller to a take-up spool, wherein said second surface speed is adjusted in relation to said first surface speed.

The present invention also provides a method for fusing or transfusing a toner based image on a print medium using a fusing or transfusing apparatus comprising

- a release agent impregnated web
- a cleaning roller that rotates in a rolling contact with the fuser surface at a first surface speed
- a release agent application roller that rotates in a rolling contact with the fuser surface at said first surface speed wherein said release agent impregnated web is advanced at a second surface speed along a trajectory from a supply spool over a first contact area with said release agent application roller, a second contact area with said cleaning roller to a take-up spool, wherein said second surface speed is adjusted in relation to said first surface speed.

The second surface speed is preferably adjusted in relation to said first surface speed to result in an amount of release agent per printed A4 sheet in the range of 0.6-5 mg per A4 sheet.

DESCRIPTION OF THE ILLUSTRATIVE EMBODIMENTS

Figure 1:
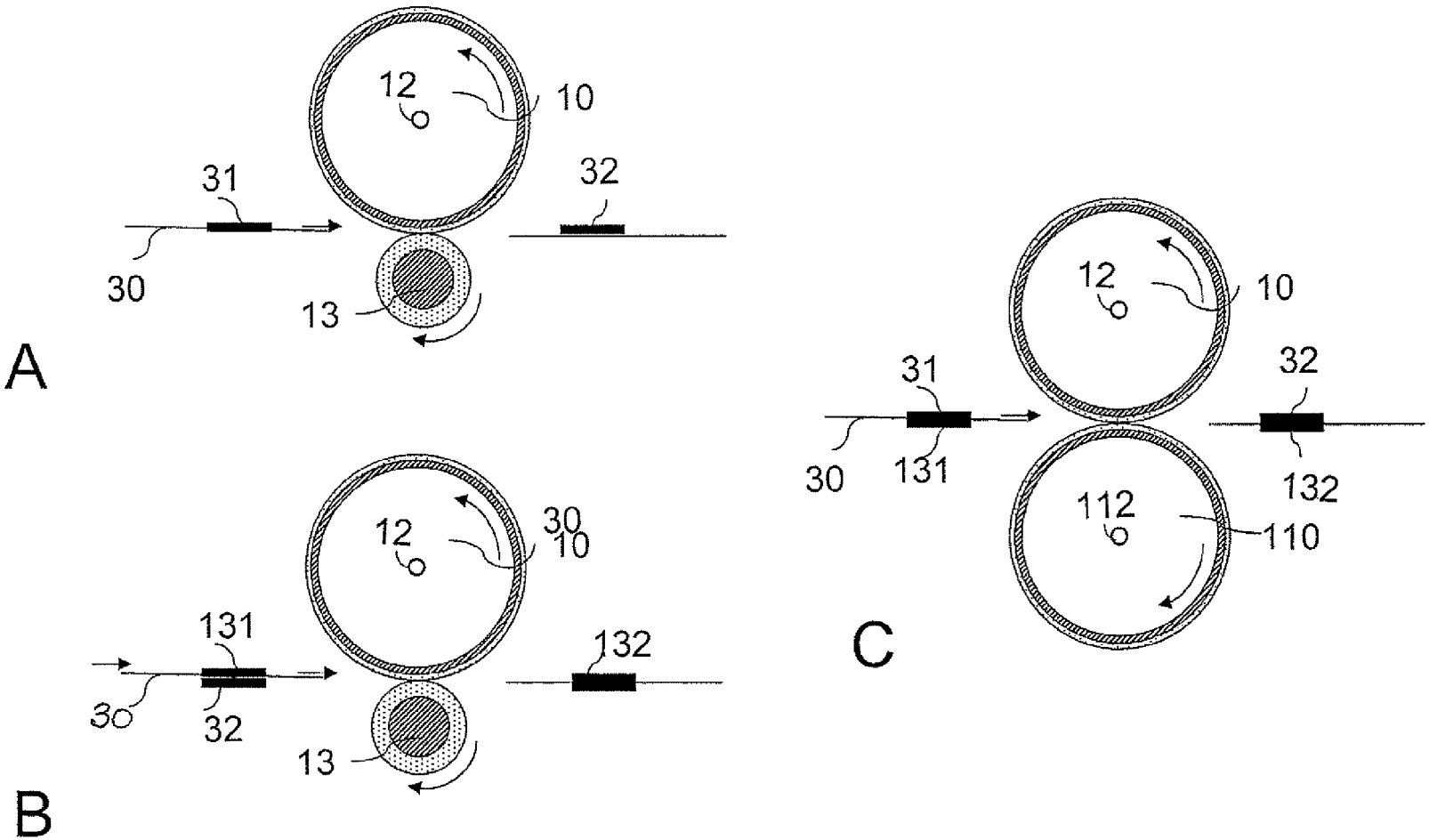
Prior Art Fig. 1
FIG. 1. Simplex (A,B) and duplex (C) fuser configurations as known from the prior art FIG. 2. Prior art configurations for cleaning and application of release agent as separate functions (A) and combined in a release agent impregnated web (B)

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. The terms "coupled" and "connected", along with their derivatives, may be used. It should be understood that these terms are not intended as synonyms for each other. Thus, the scope of the expression "a device A coupled to a device B" should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

The present invention will mainly be described with reference to a multicolour unfused toner image, that has been transferred to a print medium in a previous step, is permanently fixed by a fixing unit into a colour copy or colour print as a separate step. However, the present invention is not limited thereto and includes within its scope devices that use transfer of images, i.e. the present invention also relates to the conditioning of transfuse surfaces.

Figure 3:
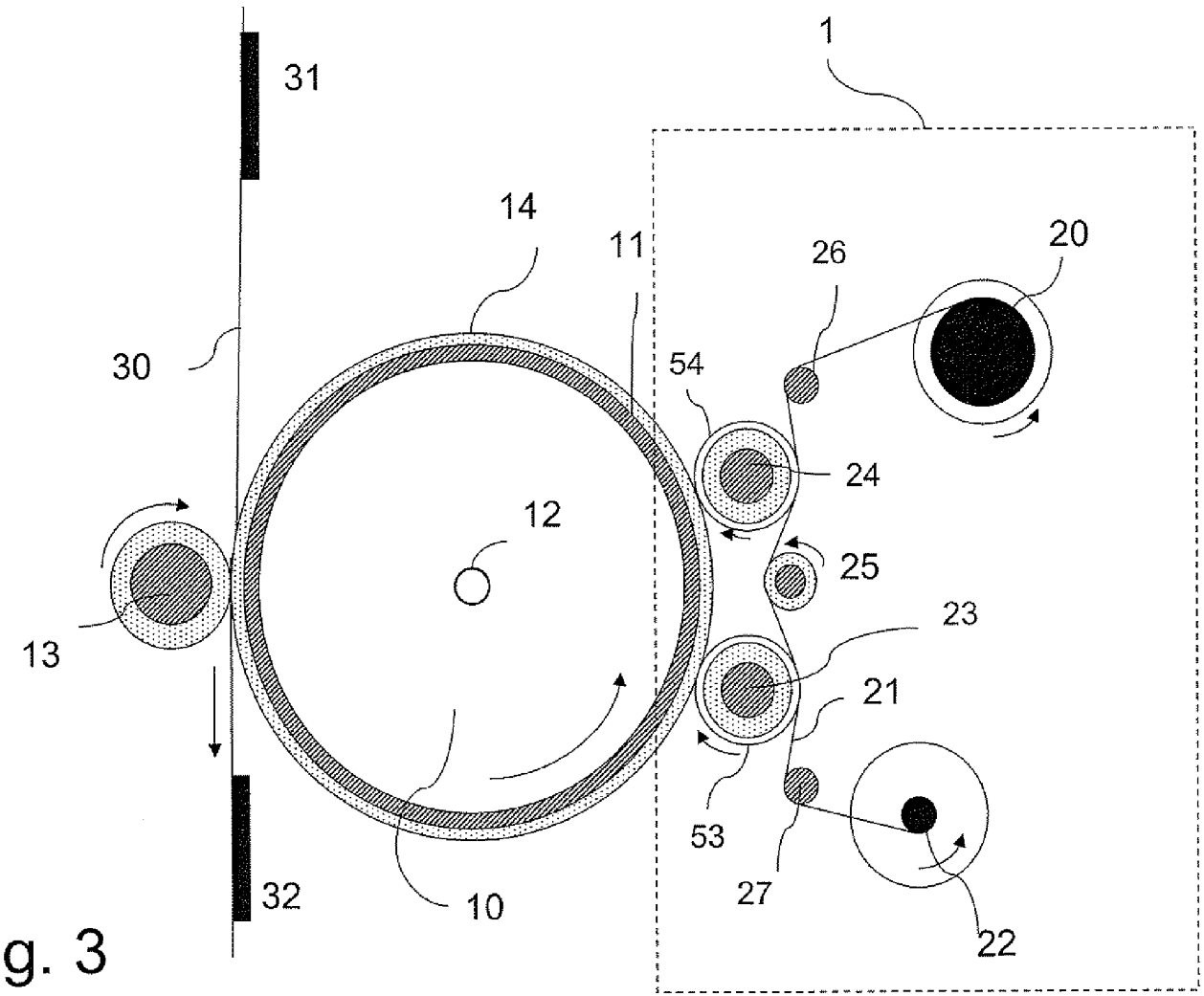
FIG. 3. shows a fuser surface conditioning apparatus according to the present invention for a simplex fuser with a web of print medium FIG. 4. shows a fuser surface conditioning apparatus according to the present invention for a simplex fuser with a web of print medium with an indication of an oil delivery path and a contaminant cleaning path FIG. 5. shows a fuser surface conditioning apparatus according to a second embodiment of the present invention for a simplex fuser with sheets of print medium FIG. 6. shows a fuser surface conditioning apparatus according to the second embodiment of the present invention for a simplex fuser with a web of print medium using medium preheating FIG. 7. shows a fuser surface conditioning apparatus according to a second embodiment of the present invention for a duplex fuser with sheets of print medium FIG. 8. shows detail of the embodiment as in FIG. 6 indicating the physical modules in operation (A) and in idle mode (B)

FIG. 3 shows a fusing apparatus with a fuser surface conditioning apparatus (1) according to a first embodiment of the present invention. A release agent impregnated web (21) is supplied in the form of a roll of release agent impregnated web wound on a supply spool (20). The web (21) is preferably guided along a trajectory defined by guides such as guiding bars (26) and (27) and a rotational pressing roll (25) such that a controlled wrap exists with a release agent application roller (24) on one hand and with a cleaning roller (23) on the other hand.

A drive mechanism such as a motor (not shown) is connected to the shaft of take-up spool (22) and provides a continuous renewal of the web. The web may be provided in a speed range of 0.2 mm/s to 2 mm/s. Tension of the web is preferably controlled by providing a brake on the shaft of the supply spool (20). Preferably web velocity measuring means are provided. For example, a pressing roller (25) can be equipped with an encoder disc on its axis for use in measuring and for use in a feedback loop for a control system for controlling the velocity of the web (21).

The web is typically made of a textile material such as a non-woven textile and has the function to hold an amount of release agent as well as having the function to deliver it to a release agent delivery roller (24). A common choice for the textile web is known as thermal bonded non-woven textile. Other examples of textiles include those known as spun bound non-woven webs and hydro-entangled non-woven webs. For use in electrophotography these webs typically comprise polyester fibres and Aramid fibres such as Nomex® from Dupont de Nemours but fibres of Imide, polyphenylene sulphide, PTFE or viscose rayon fibres can also be used. Release agent impregnated webs are manufactured at BMP Europe limited located in Accrington, Lancashire. United Kingdom and BMP America Incorporated located in Medina, N.Y. and Portland, Oreg., both in the United States of America. Suitable webs are discussed, for example, in U.S. Pat. No. 6,449,455 which is incorporated herein by reference.

Silicone fluids such as polydimethylsiloxane are the standard choice for release agents in hot roller toner fusing for fuser surfaces (14) with a silicone based outer layer. Functionalized oils such as those with phenyl-groups, amino groups or mercapto groups will be further referred to as silicone derived release agents. These silicon derived release agents can be selected for more optimal performance with high durability fuser surface surfaces with a fluorelastomer or fluoropolymer outer layers on an elastic cushion layer for which wetting by standard silicone oil is poor. Very good results were obtained with a polyester/aramid fibre web impregnated with 30 grams per square meter of web of a PDMS silicone oil of 10000 centistokes on the chosen fusing surface (14).

The fuser roll (10) of the first embodiment for a simplex fuser on a printing web as represented in FIG. 3 comprises a 140 mm diameter al tube (11) with a wall thickness of 9 mm coated with a single 130 micron thick layer silicone based resin. The pressure roller (13) is a double layer construction with a 4 mm cushion layer and a 50 micron thick fluoropolymer surface layer (not shown). This type of construction with a relatively hard fuser-roll and a soft pressure roll is preferable for simplex fusing of web-based print media. Fusing systems for sheet based print media will typically use a double-layer construction for the fuser roller or belt to create a self-stripping effect of the printed sheets.

Figure 4:
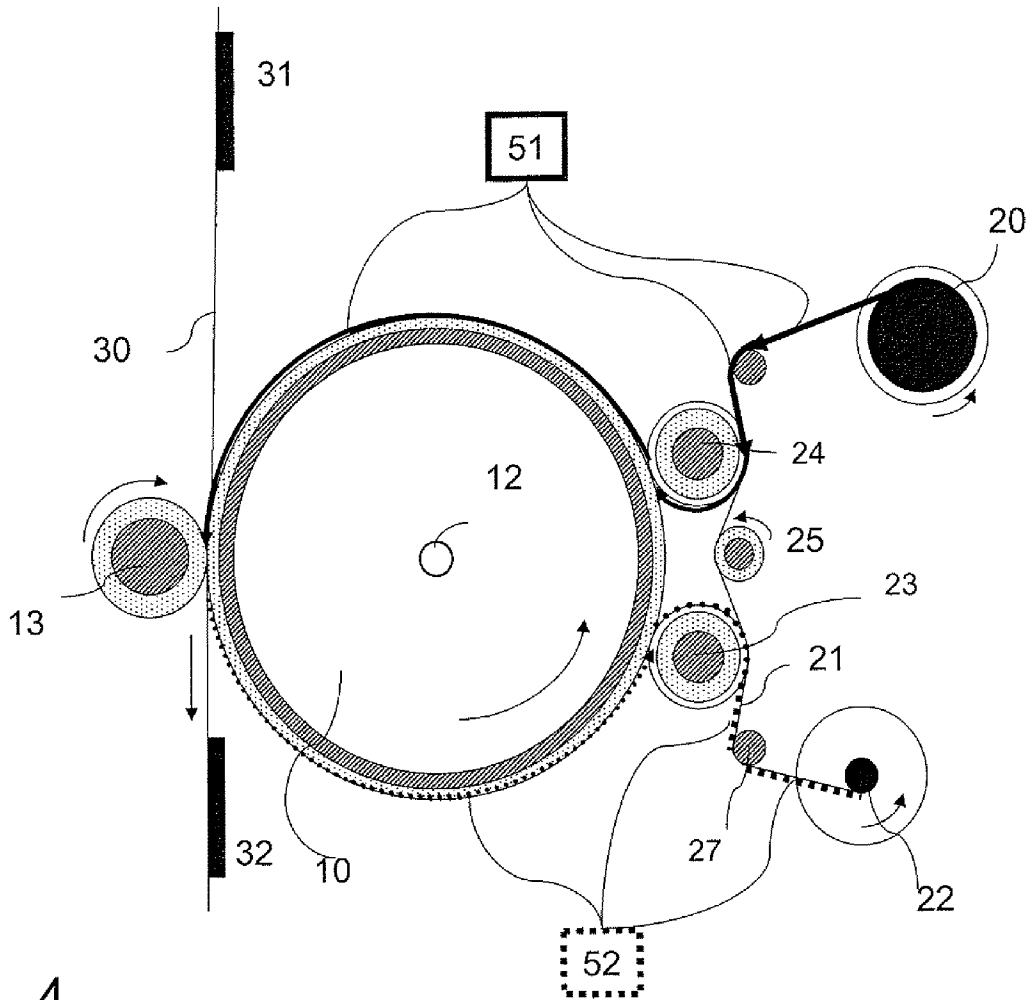

As shown in FIGS. 3 and 4, the release agent impregnated web (21) with the initial release agent loading is unwound from the supply spool (20) and brought in contact along a given wrap with a release agent application roller (24). The surface (54) of this roller is typically selected to be a surface that has a high affinity for silicone oil such as a surface made from a polydimethylsiloxane derived elastomer. Preferably, the surface wetting by a release agent such as AKF-1000 silicone oil as obtainable from Wacker Chemie, Burghausen, Germany is high. As is well-known in the art, contact angle measurement can be used as a measure for the degree of surface wetting. The contact angle of an AKF1000 droplet at room temperature on the preferred surface (54) was found to be 9 degrees. A suitable range for the contact angle can be less than 30°, e.g. from 5 to 25 degrees—more preferably from 7 to 18 degrees. Although viscosities of silicone based release agents are chosen around 10,000 centistokes, viscosities of less than 10,000 centistokes, e.g. 1000 are preferred for the contact angle measurement to avoid kinetic effects of insufficient viscous flow in the contact angle determination.

The freely rotating release agent application roller (24) is pressed towards the fusing roller (10) such that its surface (54) rotates at the same surface speed as the fusing surface (14). The release agent impregnated web (21) rotates at a much lower speed and due to the affinity of the surface (54) towards the release agent, the release application roller extracts release agent from the pores of the web (21) as it moves relative to the slowly advancing web (21). As shown in FIG. 4, the release agent is further supplied by the release agent application roller (24) to the fusing surface (14). It was found that especially in combination with a fuser roll or belt (10) that comprises a metallic base coated with a single relatively thin 130 micron silicone based resin layer it is preferable to have a conformable base for the release agent application roller 24.

The path of the release agent from the supply spool to the oil application roller and onto the fusing surface is shown as the release agent trajectory (51) in FIG. 4.

The release agent depleted web (21) follows its path along its trajectory over the pressing roll (25) to a contact zone with the cleaning roll (23). The cleaning roll surface (53) is chosen to have a low affinity for the release agent. In our preferred embodiment the surface of the cleaning roller was chosen as a fluoropolymer. The contact angle of an AKF1000 droplet at room temperature on the preferred surface (53) was found to be 34 degrees. A suitable range for the contact angle is less that 80°, e.g. from 15 to 60 degrees—More preferably from 20 to 50 degrees. As indicated in FIG. 4 as the dotted trajectory (52) toner contaminants and paper residues that were picked up from the print medium (30) and the toner images (31, 32) are preferentially picked up by the cleaning roll (23). The cleaning roll surface is rubbed against the depleted web (21) that is advancing at the much lower speed and transfers most of the contaminants to the pores of the non-woven web (21). As the web (21) advances at its reduced speed, it evacuates the contaminants towards the take-up spool (22). Use of webs to clean toner contaminants on external heating rolls made of metal have been described in U.S. Pat. No. 6,890,657. It has been found however that metal is a poor choice for a surface for cleaning roll (23). Although metal is very good in picking up contaminants from the fuser surface (14), the pickup of the contaminants from the cleaning roll to the partially depleted release agent impregnated web is poor. It has been found that optimal cleaning performance depends on a combination of a reduced surface energy (compared to metal) and a poor wetting by the release agent.

It has been found that optimal results are obtained when the cleaning roller is provided with a material that has contact angle >20 degrees with silicone oil AKF1000 whereas the solid surface energy <30 dyn/cm.

The cleaning roll of the first embodiment was provided with a spray coated outer surface of a fluoropolymer, e.g. fluorinated ethylene propylene (FEP) with a solid surface energy of 18.23 dyn/cm$^2$. Other tested fluoropolymers were sleeves of PFA with solid surface energy measurements of 18.6 dyn/cm$^2$. Both PFA and PTFE sleeves were found to be suitable alternative materials for the outer surface (53) of the cleaning roller (23).

It was found that especially in combination with a fuser roll or belt (10) that comprises a metallic base coated with a single relatively thin 130 micron silicone based resin layer, it is preferable to have a conformable base for the cleaning roller 23.

It was found that especially in combination with a fuser roll or belt (10) that comprises a metallic base coated with a single relatively thin 130 micron silicone based resin layer, it is preferable to have a conformable base for the cleaning roller 23.

As experiments have indicated, preferably slightly more than 50% of the release agent is depleted from the web (21) for an initial loading of 30 g/m$^2$ when the release agent web (21) speed is set to by 0.3 mm/s for a printing speed of 122.5 mm/sec. In the tested set up, the supply spool was dimensioned to accommodate 60 meters of web. In this case 25 kilometers of print medium could be printed before having to replace the release agent web spool (20).

Application of a uniform film of release agents is known to facilitate the stripping of the printed sheet form the fuser surface (14).

Levels for application of release agent per printed sheet are typically in the range of 10 to 20 mg per A4 size sheet for fuser system designed for sheet based full colour printers. Whereas fusing systems designed for fusing printed sheets can suffer from paper jams when the printed sheet fails to release from the fuser surface, fusing systems that operate on print media in the form of an endless web have a reliability advantage as there is no risk of jams of that nature.

The useful life of a fuser roll (10) consisting of a 140 mm diameter aluminium tube with a wall thickness of 9 mm coated with a single 130 micron thick layer silicone based resin in the absence of a fuser conditioning surface depends on the type of prints made, the print speed and the idle times in between the jobs. In table 1 a useful life of this fuser roller (10) of in between 5000 and 10000 A4 prints is listed and it is assumed that this limited life is due to the presence of silicone oligomers in the silicone network that have a certain mobility and that can migrate to the free surface where they can act as a built-in release agent. Measurement of the depletion of "natural" oil from a silicone belt over the number of copies made is reported in FIG. 7 of EP1072962 in the context of a possible application in a transfuse system. This document suggests that a target for replacing the lost natural oils would be to add 0.1 to 0.2 mg of release agent per A4 sheet. The reference does not report on the results of a similar oil on copy test over the number of copies made in a system with an oil application system.

Figure 2:
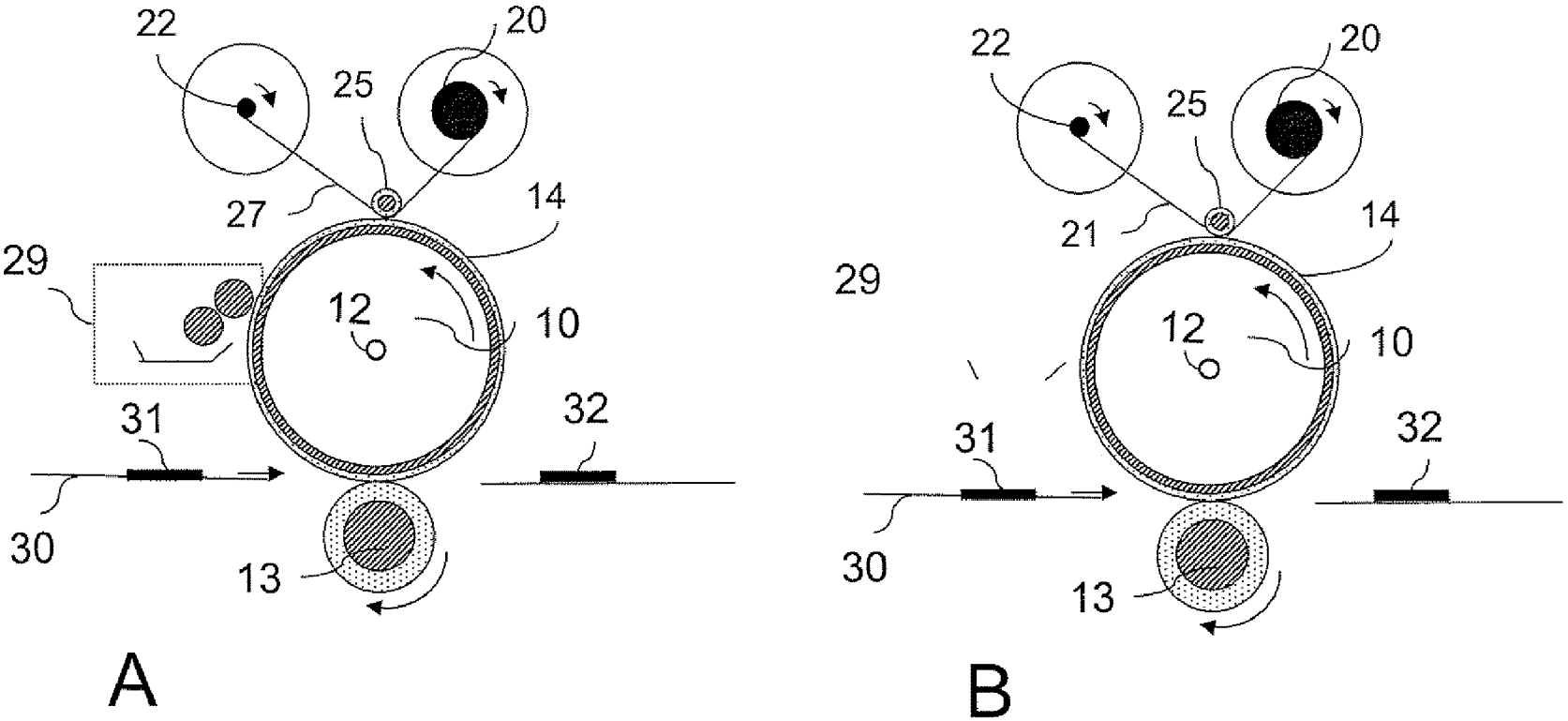
Fig. 2 Prior Art

The reference suggests the use of an release agent application system as in FIG. 2A. Tests have been conducted with an amount of release agent such that 2.4 mg/A4 and 4.8 mg/A4 of release agent is transferred to the print medium using a configuration with a release agent impregnated web in direct contact with the fuser roll (10) as in FIG. 2 *b*. A very modest increase of a factor 2 and 4 in the useful life of the fuser roll (10) was observed. This clearly indicates that, contrary to the suggestion in EP1072962, application of external release agent at the rate of the loss of "natural oil" is not a sufficient condition for maintaining the initial performance of a fuser or transfuse surface.

It has been found, however, that use of levels of release agent in the range of 0.6 to 5 mg of release agent per printed A4 sheet applied with the system (1) as described above increased the useful life of the fusing roller (10) by a factor of up to more than 40 compared to a reference run where the fuser surface conditioning system (1) was removed.

Table 1 summarizes the observations in the test.

It has been found that the combined action of cleaning the fuser surface (10) using a synchronously rotating cleaning roller (23) and applying the release agent through a synchronously rotating release agent application roller (24) allows the use of significantly lower amounts of release agent than the amounts of 10 to 20 mg/A4 of release agent that are typically used in the art to enhance the useful life of the fuser roller or belt or transfuse roller or belt (10).

Especially for industrial applications such as label printing, it is desirable to reduce the amount of release agent that is applied to the printed medium to an absolute minimum. Release agent films of more than a few milligrams per sheet are known to interfere with subsequent production steps such as the application of a protecting and/or gloss enhancing varnish. Use of higher amounts of release agent necessitates a higher release agent loading of the release agent impregnated web (21) or a higher speed of the release agent impregnated web (21). The maximum amount of release agent that can be loaded in a web without problems of oil dripping out is limited however. An increase of the speed of the release agent impregnated web (21) shortens the interval of replacement of the supply spool (20) and take-up spool (22). High amounts of release agent on the printout compromise the possibility to write with a ballpoint pen on the printed copy, which can be a desirable feature for pre-printed labels.

Preferred levels of release agent application to the printed medium are in the range 0.6 to 5 mg/A4 and more preferentially in the range of 0.8 to 2.5 mg/A4.

Figure 5:
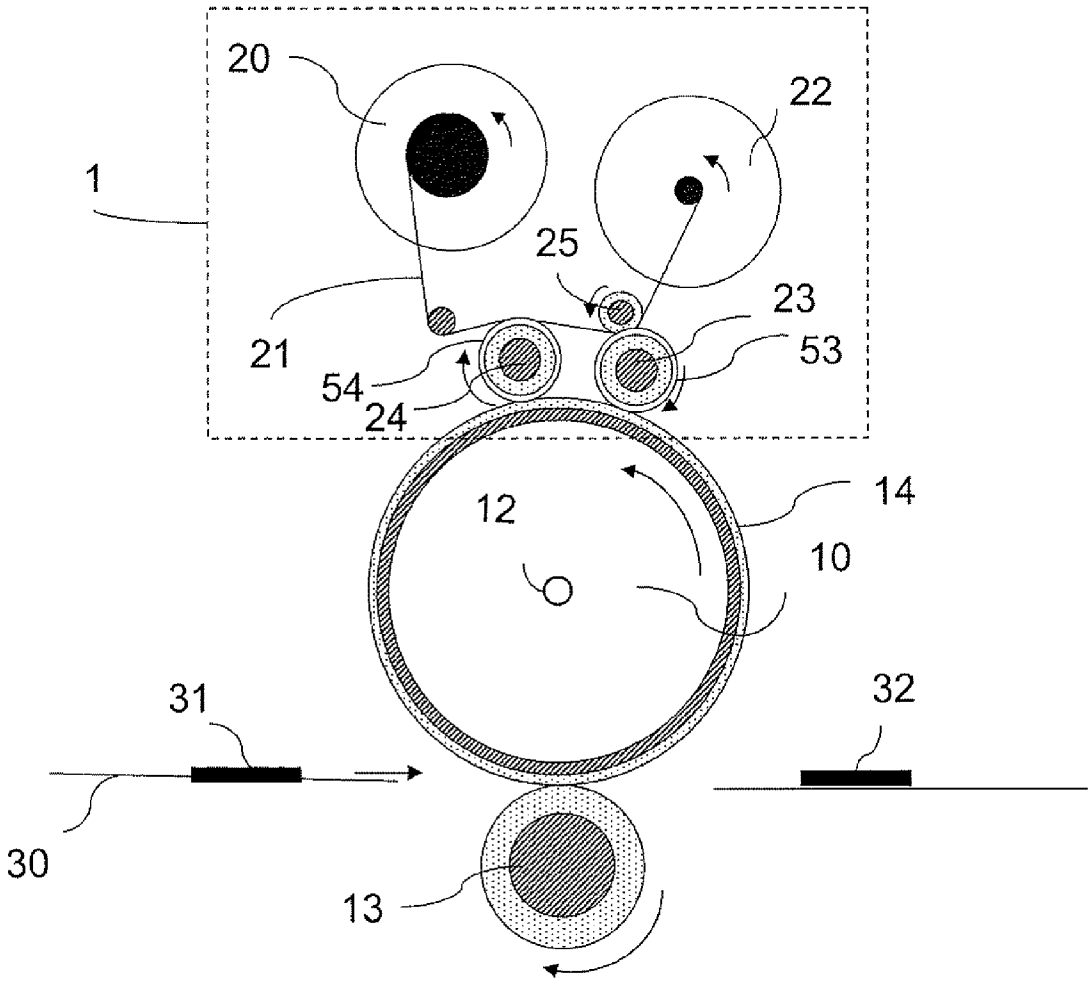

FIG. 5. shows a second embodiment of the fuser surface conditioning apparatus in a simplex configuration for print media in the form of sheets. In this embodiment the pressing roller (25) is configured to form a nip contact with the cleaning roller (23). The guiding roller (27) of FIG. 3 is omitted in this case as the trajectory of the release agent impregnated web (21) towards the take-up spool is fully defined by the wrap around the cleaning roller (23). In this preferred embodiment the foam based pressing roller has sufficient compressibility that it can be provided on a fixed position rather than being spring loaded. It was observed that the cleaning performance of this second embodiment is improved compared to the first embodiment as represented in FIG. 3. It was found that in the event that significant amounts of toner had to be cleaned form the fuser surface as can happen when the temperature of the fusing surface (14) has been erroneously set too high or too low, the configuration of FIG. 3 is less robust with respect to the failure mode where the web (21) sticks to the fuser surface (14) and wraps around the fuser drum (10) in comparison to the configuration of FIG. 5 where the pressure and the wrap around the cleaning roller (23) are higher and better controlled. For an even more improved control of the web tension of web (21) and the speed of the web (21), the supply spool is equipped with a motor that is controlled in speed mode, the pressing roll (25) is equipped with an encoder and the take-up spool is equipped with an motor that is pulling with a constant torque. It was found that the cleaning performance was enhanced while preserving the release agent delivery performance of the first embodiment.

Figure 6:
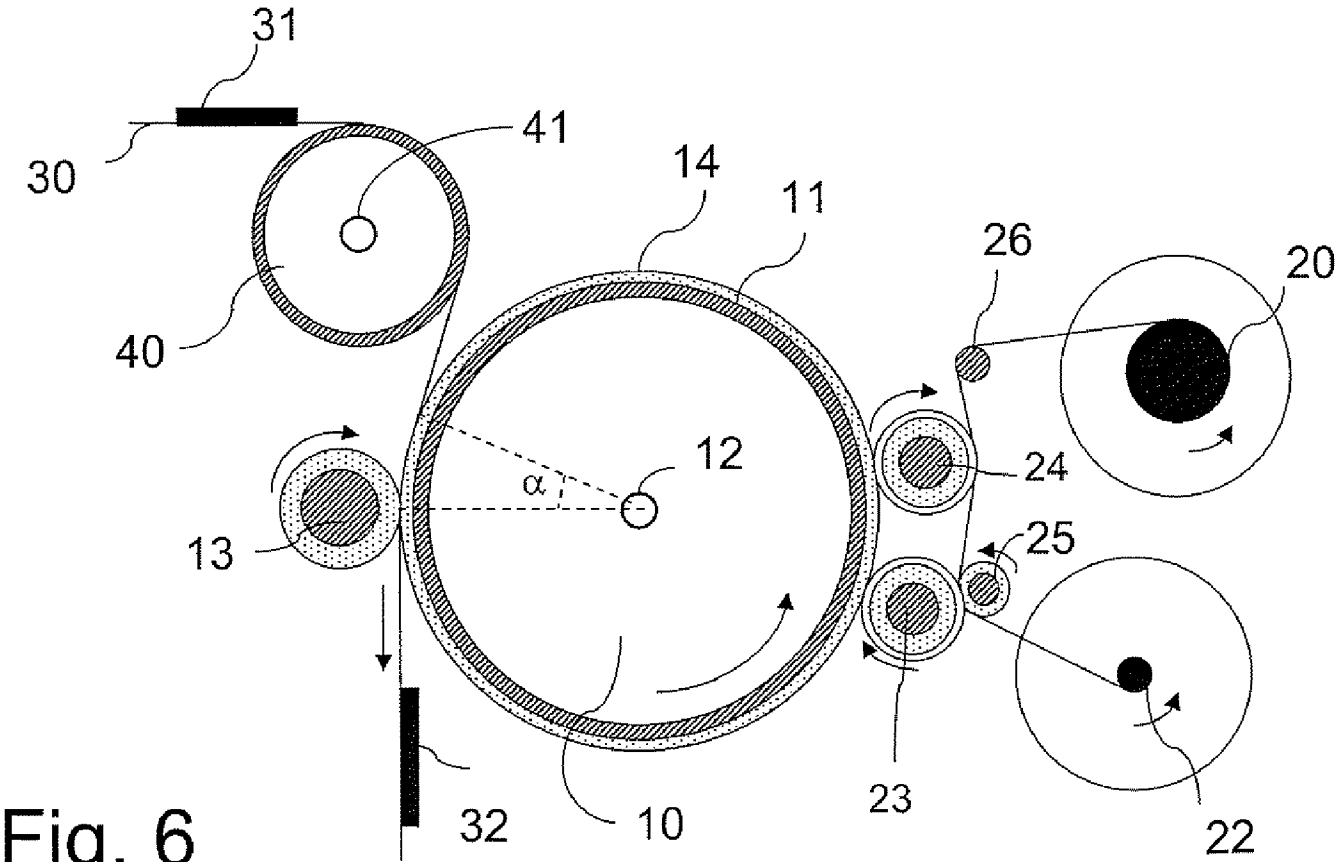

FIG. 6 shows the same fuser surface conditioning apparatus as implemented on a simplex fuser for fusing images on a print medium in the form of a web. The incoming print medium (30) with an unfused toner image (31) is guided over a preheating roller 40 equipped with a heating lamp (41) so as to preheat the print medium from the back in an extended contact zone as the web (30) is wrapped over the preheating roller (40). The preheated web (30) is then guided along a web trajectory that is designed as to bring the web in contact with the fuser surface (14) well in advance of the nip between the Fuser roller or belt (10) and the pressure roller or belt (13). The length of time when where the print medium is guided in contact with the fuser surface (14) is further referred to as the pre-nip contact length and is determined by the angle $\alpha$. Pre-heating the paper in the range from 70 to 90 degrees C. and pre-nip contacts in the range of 10-30 mm were found to contribute to the fusing performance at high printing speeds.

Figure 7:
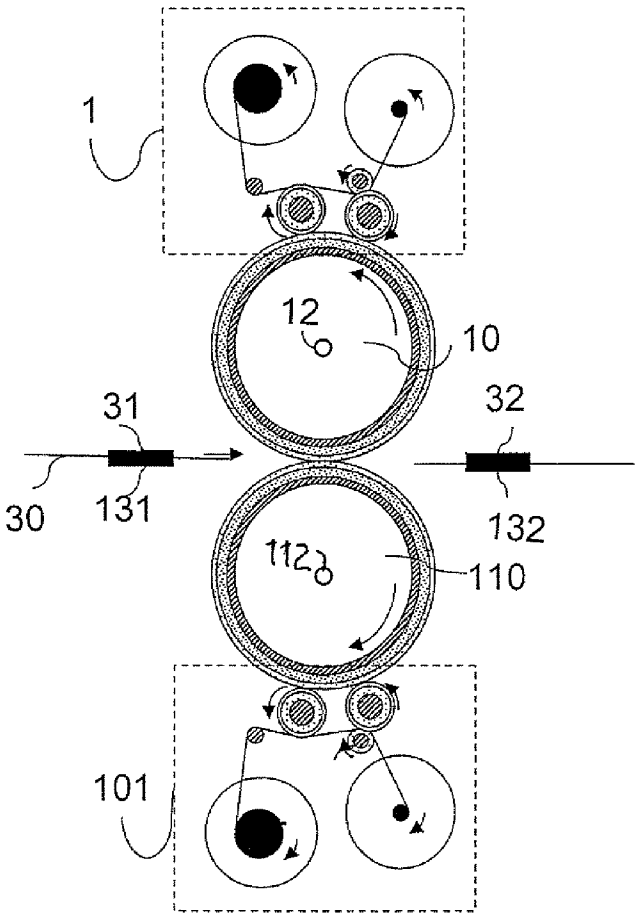

FIG. 7 shows an alternative embodiment of a symmetric duplex fuser where a fuser surface conditioning apparatus according to the present invention is provided on each of the multilayer fuser rolls (10 and 110). A first fusing surface conditioning apparatus (1) is provided on the upper fuser roller or belt (10) and a second fusing surface conditioning apparatus (101) is provided on the lower fuser roller or belt (110). Contrary to release agent application devices (29) based on rollers as in FIG. 2 A, the fuser surface conditioning apparatus of the present invention allows architectural flexibility as it can be rotated without any significant effect on its performance.

Figure 8A:
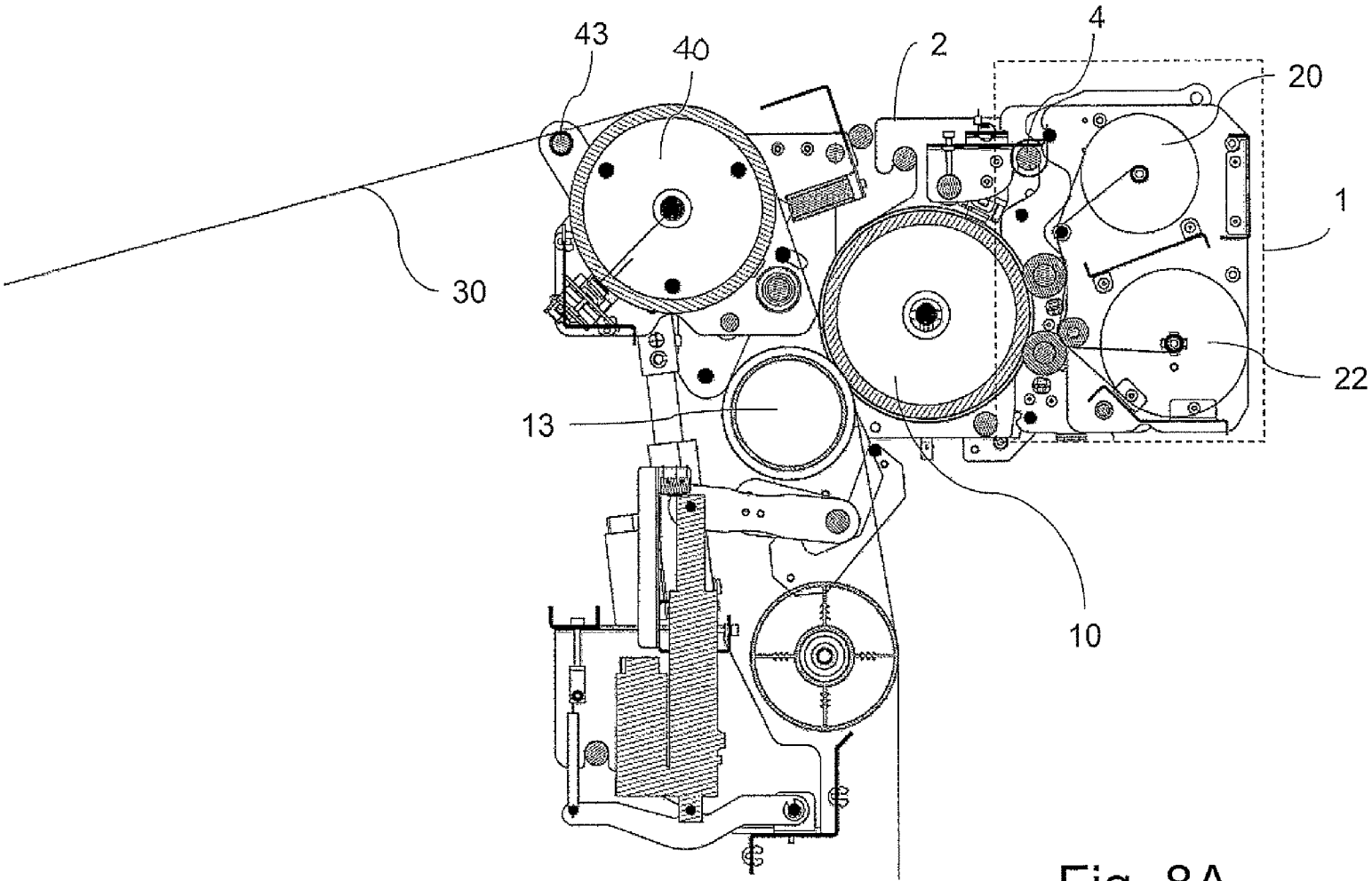
Figure 8B:
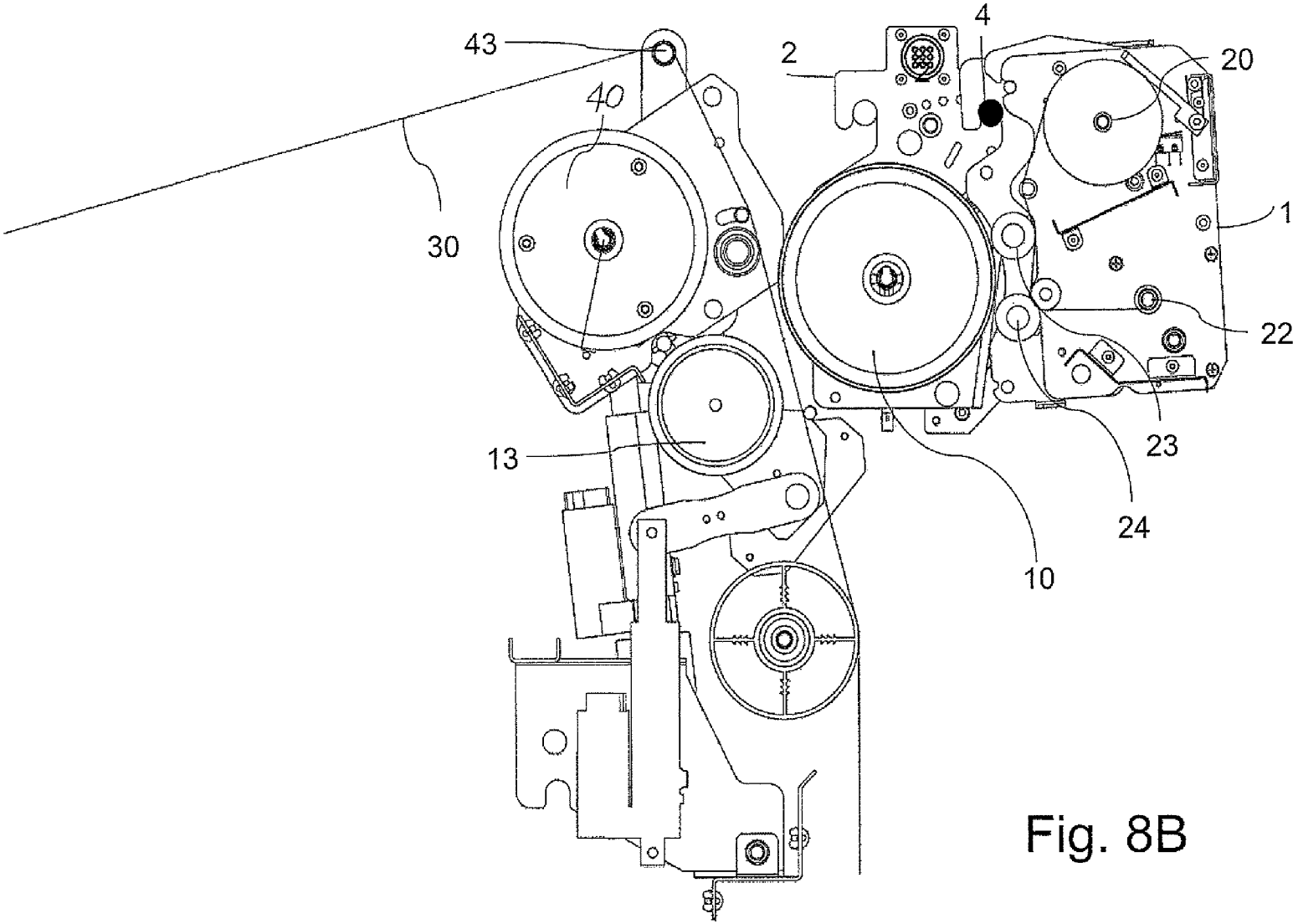

FIG. 8 A shows a detailed view of how the configuration as in FIG. 5 can be organized in physical modules. The fuser surface conditioning apparatus (1) can be made as a separate module supported on an axis and is provided with an actuator (not shown) that can be activated to bring the fuser surface conditioning apparatus (1) in an idle position as in FIG. 8 B such that the conformable rollers (23) and (24) do not deform due to static contact pressure in the idle state with the fuser surface (14). The fuser surface conditioning module (1) can be removed for service is made out of separate frames to facilitate replacement of the supply spool and installing of a new release impregnated web (21). The fuser roller (10) can be provided as a separate module (2) that can be removed for service. As an apparatus as in FIG. 5 is frequently used for industrial applications such as printing on films and on label materials that often consist of materials other than paper such as polypropylene and other thermoplastic layers that may suffer damage and deform in contact with stationary heated rollers, the apparatus is preferentially provided with actuators (not shown) that effect the position of the pressure roller (13), the preheating roller (40) and the web of print medium (30) such that the web of print medium is brought to a alternative web trajectory in FIG. 8 B. The alternative web trajectory is such that the web of print medium (30) is separated from the pressure roller (13), the fuser roller (10) and the pre-heating roller (40) has preferentially the same length as the web trajectory in operational position as in FIG. 8 A. The web trajectory can therefore be altered from "idle" to "operational" without affecting the tension in the print medium (30) in the upstream part of the print engine that may already be providing toner images on the web.

TABLE 1

| | Release agent web | first web speed | second web speed | estimated amount of release agent on sheet | life prolongation % | fuser life 140 mm monolayer drum |
|---|---|---|---|---|---|---|
| No surface conditioning unit installed | | 122.5 mm/s | | <0.3 mg/A4 | 100 | 7.5K A4 (5K-10K A4) |
| Direct contact configuration as in FIG. 2 B | web 60 g/m$^2$ | 122.5 mm/s | 0.3 mm/s | 4.8 mg/A4 | 400 | 30K A4 |
| | web 30 g/m$^2$ | 122.5 mm/s | 0.3 mm/s | 2.4 mg/A4 | 200 | 15K A4 |
| Surface conditioning unit as in FIG. 3 | web 60 g/m$^2$ | 122.5 mm/s | 0.3 mm/s | 4.8 mg/A4 | >4000 | >300K A4 |
| | web 30 g/m$^2$ | 122.5 mm/s | 0.15 mm/s | 1.2 mg A4 | >4000 | >300K A4 |
| | web 30 g/m$^2$ | 245 mm/s | 0.3 mm/s | 1.2 mg/A4 | >4000 | >300K A4 |
| | web 30 g/m$^2$ | 245 mm/s | 0.3 mm/s | 1.2 mg/A4 | >4000 | >300K A4 |
| | web 30 g/m$^2$ | 245 mm/s | 0.15 mm/s | 0.6 mg/A4 | 800 | 60K A4 |

The invention claimed is:

1. An apparatus for fusing or transfusing a toner based image on a print medium using a fuser roll having a fuser surface, comprising:

a release agent impregnated web a cleaning roller that rotates in a rolling contact with the fuser surface at a first surface speed a release agent application roller that rotates in a rolling contact with the fuser surface at said first surface speed wherein said release agent impregnated web is advanced at a second surface speed along a trajectory from a supply spool over a first contact area with said release agent application roller to a take-up spool, wherein said second surface speed is at least 100 times lower than said first surface speed.

2. The apparatus of claim 1 wherein said cleaning roller has a first surface and said release agent application roller has a second surface and where the contact angle at room temperature of a silicone fluid droplet on said first surface is more than 2 times bigger than the contact angle on said second surface.

3. The apparatus of claim 1 wherein the surface energy of the first surface is less than 30 dyne/cm.

4. The apparatus of claim 1 wherein the release agent impregnated web is loaded with 10-60 gr/m$^2$ of a silicone or silicone derived release agent with a viscosity between 1000 and 20000 centistokes at room temperature.

5. The apparatus of claim 1 wherein the contact region of the release agent impregnated web and the cleaning roller is a pressure contact provided by a conformable sponge rubber type pressing roller engaged against said cleaning roller.

6. An apparatus for fusing or transfusing a toner based image on a print medium using a fuser roll having a fuser surface, comprising:

a release agent impregnated web;

a cleaning roller that rotates in a rolling contact with the fuser surface at a first surface speed;

a release agent application roller that rotates in a rolling contact with the fuser surface at said first surface speed; and web advancing apparatus arranged to advance said release agent impregnated web at a second surface speed along a trajectory from a supply spool over a first contact area with said release agent application roller and over a second contact area with said cleaning roller to a take-up spool, wherein said second surface speed is at least 100 times lower than said first surface speed.

7. The apparatus of claim 6 wherein said cleaning roller has a first surface and said release agent application roller has a second surface and where the contact angle at room temperature of a silicone fluid droplet on said first surface is more than 2 times bigger than the contact angle on said second surface.

8. The apparatus of claim 6 wherein the surface energy of the first surface is less than 30 dyne/cm.

9. The apparatus of claim 6 wherein the release agent impregnated web is loaded with 10-60 gr/m$^2$ of a silicone or silicone derived release agent with a viscosity between 1000 and 20000 centistokes at room temperature.

10. The apparatus of claim 6 wherein the contact region of the release agent impregnated web and the cleaning roller comprises a pressure contact provided by a conformable sponge rubber type pressing roller engaged against said cleaning roller.

11. A method for fusing or transfusing a toner based image on a print medium using a fusing or transfusing apparatus including a fuser roller having a fuser surface;

a release agent impregnated web;

a cleaning roller that rotates in a rolling contact with the fuser surface at a first surface speed;

a release agent application roller that rotates in a rolling contact with the fuser surface at said first surface speed; and web advancing apparatus; comprising the steps:

advancing via said web advancing apparatus said release agent impregnated web at a second surface speed along a trajectory from a supply spool over a first contact area with said release agent application roller to a take-up spool; and adjusting via a speed controlling apparatus the second surface speed in relation to said first surface speed.

12. The method of claim 11 wherein the release agent impregnated web contains between 10 and 60 g/m$^2$ of the release agent.

13. The method of claim 11, wherein the release agent is a silicone or silicone derived release agent.

14. The method of claim 11, wherein the release agent has a viscosity between 1000 and 20000 centistokes at room temperature.

15. The method of claim 11, wherein said second surface speed is adjusted in relation to said first surface speed to result in an amount of release agent per printed A4 sheet in the range of 0.6-5 mg per A4 sheet.

16. A method for fusing or transfusing a toner based image on a print medium using a fusing or transfusing apparatus including a fuser roll having a fuser surface, comprising:

a release agent impregnated web;

a cleaning roller that rotates in a rolling contact with the fuser surface at a first surface speed;

a release agent application roller that rotates in a rolling contact with the fuser surface at said first surface speed;

the method comprising the steps:

advancing said release agent impregnated web at a second surface speed along a trajectory from a supply spool over a first contact area with said release agent application roller, and over a second contact area with said area with said cleaning roller to a take-up spool, and adjusting said second surface speed in relation to said first surface speed.

17. The method of claim 16 wherein the release agent impregnated web contains between 10 and 60 g/m$^2$ of the release agent.

18. The method of claim 16, wherein the release agent is a silicone or silicone derived release agent.

19. The method of claim 16, wherein the release agent has a viscosity between 1000 and 20000 centistokes at room temperature.

20. The method of claim 16, wherein said second surface speed is adjusted in relation to said first surface speed to result in an amount of release agent per printed A4 sheet in the range of 0.6-5 mg per A4 sheet.

* * * * *